United States Patent [19]

Kuus et al.

[11] Patent Number: 4,851,733

[45] Date of Patent: Jul. 25, 1989

[54] ELECTRIC LAMP HAVING A METAL FOIL WITH A CONVEXLY AND CONCAVELY CURVED SURFACE

[75] Inventors: Gijsbert H. C. Kuus; Godefridus Heijnen, both of Eindhoven, Netherlands

[73] Assignee: U.S. Philips Corporation, New York, N.Y.

[21] Appl. No.: 124,424

[22] Filed: Nov. 23, 1987

Related U.S. Application Data

[63] Continuation of Ser. No. 849,227, Apr. 7, 1986, abandoned.

[30] Foreign Application Priority Data

Apr. 9, 1985 [NL] Netherlands ..... 8501026

[51] Int. Cl.[4] ..... H01J 61/36

[52] U.S. Cl. ..... 313/331; 313/623; 174/50.64

[58] Field of Search ..... 174/50.64; 313/331, 313/332, 623, 579

[56] References Cited

U.S. PATENT DOCUMENTS

| | | | |
|---|---|---|---|
| 3,105,867 | 10/1963 | Meijer | 313/331 |
| 3,571,899 | 3/1971 | Sobieski | 29/412 |
| 4,254,356 | 3/1981 | Karikas | 313/217 |
| 4,587,454 | 5/1986 | Bonzali et al. | 313/331 |

FOREIGN PATENT DOCUMENTS 551136 2/1943 United Kingdom .

*Primary Examiner*—David K. Moore
*Assistant Examiner*—Mark R. Powell
*Attorney, Agent, or Firm*—Emanuel J. Lobato; Brian J. Wieghaus

[57] ABSTRACT

An electric lamp has elongated metal foils as a part of the current conductor lead-throughs. Each metal foil has major surfaces which meet one another along each opposing side edge of the foil at an acute angle. The metal foil has a cross-section transverse to the side edges. At least one of the major surfaces has a pair of concave curvature portions each adjoining a respective side edge, and a convex curvature portion extending between the pair of concave curvature portions.

12 Claims, 1 Drawing Sheet

ELECTRIC LAMP HAVING A METAL FOIL WITH A CONVEXLY AND CONCAVELY CURVED SURFACE

This is a continuation of application Ser. No. 849,227, filed Apr. 7, 1986 now abandoned.

BACKGROUND OF THE INVENTION

The invention relates to an electric lamp comprising a lamp vessel of glass having an $SiO_2$ content of at least 95% by weight, within which an electric element is arranged.

Metal foils each having two major surfaces limited by a first and a second end of the foil and by side edges extending from the first to the second end are connected at their first ends to a respective inner current conductor, which extends to the electric element, and are connected at their second ends to a respective outer current conductor.

The metal foils are surrounded between their first and second ends in a vacuum-tight manner by glass of the lamp vessel;

The major surfaces of each of the metal foils adjoin each other at the side edges at an acute angle, a major surface having a convex curvature transverse to the side edges.

Such a lamp is known from U.S. Pat. No. 3,571,899 (G.E. 3-23-1971).

For lead-through members in lamp vessels of glass having an $SiO_2$ content of at least 95% by weight, use has to be made of metals having a high melting point, such as, for example, molybdenum and tungsten because of the high processing temperature of this glass. These metals, like bodies consisting mainly of one of these metals, have a thermal coefficient of expansion which is much higher than that of the glass. A vacuum-tight connection of the glass to these metals can nevertheless be obtained provided that the metal is in the form of a foil which, has a small thickness and is knife-shaped (feathered) at its side edges.

The aforementioned U.S. Pat. No. 3,571,899 states that the angle ($\alpha$) at which the two major surfaces of the metal foil adjoin each other at the side edges may be at most approximately 5°. Furthermore, according to this Patent Specification, the width of the metal foil (i.e. the distance between the side edges) must be at least approximately a hundred times the largest thickness (i.e. the largest distance between the two major surfaces). This ratio has for a long time been deemed necessary; cf. British Patent Specification No. 551,136 (Siemens Electric Lamps and Supplies Ltd., Feb. 9, 1943), which states a ratio of at least 100 and preferably of approximately 200.

The largest thickness of a metal foil generally lies between 10 and 120 $\mu$m and mostly between approximately 30 $\mu$m and approximately 100 $\mu$m. These thicknesses result in that the width of the foil generally has to be at least approximately 3 mm to approximately 10 mm. Mostly the space available limits in an electric lamp the width of the metal foil, as a result of which, in view of the requirements with respect to the angle ($\alpha$) and the ratio between width and thickness, the largest thickness of the foil is determined. Especially in the case where the space available is small and therefore the foil is narrow and consequently very thin, the current density in the foil may be very high because the surface area of the cross-section of the foil is then small. A comparatively large amount of energy is then dissipated in the foil, which gives rise in situ to an unfavorably high temperature and to loss of efficiency of the lamp.

Another consequence of the use of a thin metal foil is that, when a welding connection is made between the metal foil and the inner current conductor or the outer current conductor, rupture is liable to occur due to the fact that the foil melts. Also when the foil is embedded in the glass of the lamp vessel, this operation being effected usually by means of pinch blocks, rupture is liable to occur, for example, due to the fact that the thin foil has become brittle at a welding area. The risk of rupture during welding is reduced according to the aforementioned U.S. Pat. Specification in that during the manufacture of the metal foil there is applied at the area at which a welding connection is to be made a coating which protects the foil at this area from etching liquid used to give the foil convexly curved major surfaces and sharp side edges. However, the total of the manufacturing process as measured in time and money is increased by the additional operations of applying the coating and removing it afer etching.

A thin metal foil also renders it difficult to manipulate this foil, and a unit comprising this foil during the assembly of a lamp, due to the fact that this unit is very weak.

SUMMARY OF THE INVENTION

The invention has for its object to provide an electric lamp of the kind mentioned, whose metal foils have a shape such that with an equal current intensity they have a lower current density compared with the known kind of foils and, without special precautions being required for this purpose, the metal foils permit mechanically and electrically suitable welding connections with either an inner, an outer current, or both current conductors to be connected to each foil.

According to the invention, this object is achieved in a lamp of the kind described in the opening paragraph in that at the major surface having the convex curvature the metal foils are concavely curved along the side edges, in a direction at right angles to these side edges.

While maintaining acute angles ($\alpha$) between the major surfaces of a metal foil at its side edges, the thickness of this foil can increase considerably over a very small distance from these side edges if the foil is concavely curved along the side edge at the major surface having the convex curvature. As a result, a foil having a given width can attain a larger thickness in a region at a certain distance from the side edges. Due to the acute angle ($\alpha$), the glass of the lamp vessel nevertheless can match the shape of the foil when a seal is made around the metal foil.

The metal foils can have an even larger thickness at a certain distance from the side edges if both major surfaces have a convex curvature and a concave curvature along the side edges.

Especially if the lamp vessel can accommodate only a very narrow foil having a width of, for example, 1 to 2 mm, it is of importance for reasons of mechanical strength (to prevent occurrence of rupture due to tensile stress during a pinching operation), resistance to heat (to prevent occurrence of melting during a welding operation), electrical conductivity (to prevent high electrical losses due to a high resistance) and rigidity (to improve the manipulability of a current conductor, of which the foil forms a part) that the largest thickness of the metal foil is not at most 0.01 times the width, i.e. 10 and 20 μm, respectively, but is larger. Due to the step according to the invention, the ratio of "width" to "largest thickness" of the metal foil can be smaller to very much smaller than 100. For example, it has been found that with a width of the metal foil of 1000 μm a largest thickness of 100 μm and hence a ratio of "width" to "largest thickness" of 10 can be achieved. Due to the large thickness of the metal foils, an outer, an inner, or both current conductor can be readily welded to the foil.

The metal foils can be obtained by starting from a metal strip. Alternatively, the starting material may be a wire locally flattened to form a strip. In the latter case, a non-flattened wire portion may serve as an inner or outer current conductor and it is no longer necessary for a welding connection to be made.

The metal strip can be processed to a foil by etching the strip electrochemically. The strip is then introduced into an etching bath, for example a solution of 30 to 50% by weight of sodium hydroxide in water, opposite to an electrode whose surface is at least for the major part the mirror image of the major surface of the metal foil to be obtained. The strip may also be arranged between two of these electrodes to provide the required curvature of both major surfaces simultaneously. The strip is then connected to the anode of a current source and the electrodes are connected to the cathode thereof. In general, a current source of a few volts will suffice. At the area at which the distance between a strip and an electrode is a minimum, the electric field strength and hence the etching rate is a maximum. As a result, an etching rate varying over the width of the strip (from side edge to side edge) and hence a foil of the desired profile can be obtained.

The metal foils generally consist mainly of tungsten or molybdenum, for example of molybdenum containing up to 1% by weight of $Y_2O_3$. They may be coated with a film of another metal, for example tantalum or chromium.

The electric element may be a filament, for example a filament in a halogen-containing gas. The electric element may alternatively be an electrode pair in an ionizable gas that may contain, for example a metal, such as mercury, or a rare gas, such as xenon, and further halides, such as, for example, those of sodium, thallium, indium, rare earth metals and, as the case may be, a rare gas as starting gas. The tip of the inner conductor extending into the lamp vessel can then act as an electrode, but it is possible that the inner conductor carries an electrode body. The electric element may alternatively be a pair of field concentrators in an ionizable gas, in which event the lamp is intended to be supplied from a high-frequency source. The lamp vessel may be surrounded by an outer bulb.

BRIEF DESCRIPTION OF THE INVENTION

Embodiments of the lamp according to the invention will now be described with reference to the accompanying drawing. In the drawing.

DESCRIPTION OF THE PREFERRED EMBODIMENTS

Figure 1:
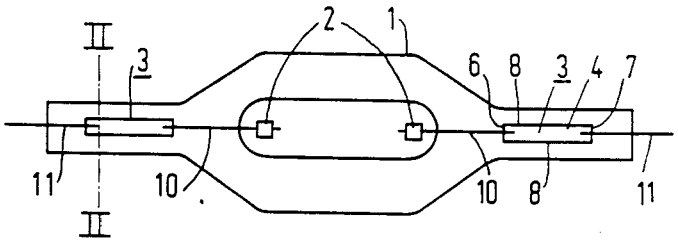
FIG. 1 is a side elevation of a high-pressure gas discharge lamp.

In FIG. 1, an electrode pair 2 is arranged as an electric element within a lamp vessel 1 of glass having an $SiO_2$ content of at least 95% by weight. The electrodes 2 are welded to a respective inner current conductor 10. Metal foils 3, are connected at a first end 6 to a respective inner current conductor 10 and are connected at a second end 7 to a respective outer current conductor 11, and are surrounded between their first ends 6 and their second ends 7 in a vacuum-tight manner by glass of the lamp vessel 1. In FIG. 1, the electrodes 2, like the foils 3, are located opposite each other. However, the electrodes and foils could alternatively have been arranged beside each other. The lamp vessel contains an ionizable filling comprising mercury, argon, NaI, $ScI_3$ and $ThI_4$.

Figure 2:
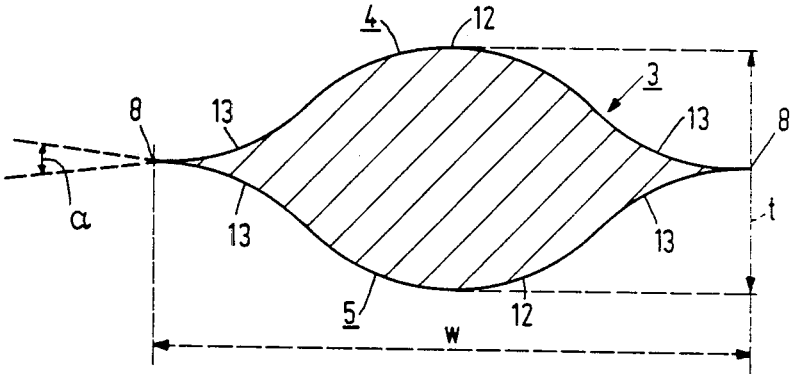
FIG. 2 is a diagrammatic sectional view taken on plane II—II of a metal foil of FIG. 1.

Each foil extends in a direction of elongation generally parallel to edges 8 between the first and second ends 6 and 7. The cross-section of the foil 3 shown in FIG. 2 shows a pair of major surfaces 4 and 5 extending between the side edges 8. Each of the surfaces 4 and 5 has a smoothly curved concave portion 13 adjoining each edge 8, and a smoothly curved convex portion 12 extending between and connecting the portions 13. The surface smoothly passes from concave to convex.

The major surfaces 4 and 5 meet at the edges 8 at an acute angle α which is, preferably, at most 5°.

Figure 3:
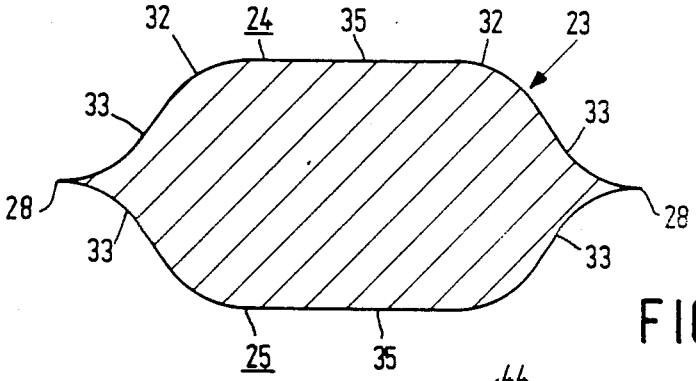
FIG. 3 shows a variation of the sectional view corresponding parts of FIG. 3 are designated by a reference numeral which is 20 higher than shown in FIG. 2.

As shown in FIGS. 2 and 3 which are sectional views at right angles to the side edges 8, each metal foil 3 of the electric lamp according to the invention may have one of a variety of shapes. For example, in FIG. 2, and metal foil 3 may have a shape in which a concave curvature along the side edges passes into the convex curvature, which is in a region halfway between the side edges. The ratio between width and largest thickness in the metal foils of lamps according to the invention is smaller than 100, but especially smaller than 80, more particularly smaller than 50, for example about 10. It should be noted that due to the concave curvature along the side edges of the metal foils, the thickness of the metal foil decreases to a given desired value at a smaller distance from the side edges in comparison to the known metal foil having solely a convex curvature and the same angle (α) at the side edges. As a result, metal foils having concave curvatures even with a ratio between width and largest thickness of 100 already have the advantage as compared with known metal foils of a larger surface area of the cross-sections and hence of lower current densities.

Figure 4:
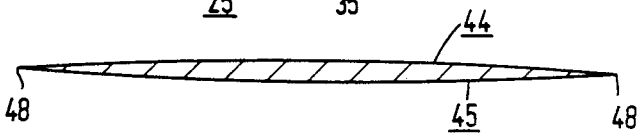
FIG.4 (PRIOR ART)
FIG. 4 is a similar sectional view of a known metal foil.

In FIGS. 2, 3 and 4 the largest thickness t of the foil is shown for the sake of clarity on a four times larger scale than the width w of the foil. In FIG. 2, the major surfaces 4 and 5 of the foil 3 each have a concave curvature 13 along each of both side edges 8, which smoothly passes into a convex curvature 12, which is in a region halfway between the side edges 8. The major surfaces 4 and 5 adjoin each other at an acute angle (α), for example an angle of at most 5°. The foil has a largest thickness t of 100 μm and a width w of 1000 μm.

In FIG. 3, another shape of cross-section of the metal foils is shown in which the major surfaces in a region halfway between the side edges are flat and thus have towards the side edges on both sides a convex curvature and near the side edges a concave curvature. Along the two side edges 28, the two major surfaces have a concave curvature 33 which gradually passes into a convex curvature 32. Between the convex curvatures 32 a flat region 35 is present halfway between the side edges 28.

In an alternative embodiment, the metal foils have a cross-section which can be derived from that shown in FIG. 2 or FIG. 3 by drawing a straight line 8—8 and 28—28, respectively. The straight line determines the second non-profiled major surface of a metal foil having a first major surface 4 and 24, respectively, i.e., one major surface is moved as in FIG. 2 or FIG. 3 while the other major surface is flat.

FIG. 4 shows a sectional view at right angles to the side edges 48 of a known metal foil. The major surfaces 44 and 45 are convexly curved in a direction transverse to the side edges 48.

A comparison of FIGS. 2 and 3 on the one hand with FIG. 4 on the other hand shows that there is a great difference in the ratio between width and largest thickness and hence a great difference in mechanical strength, in resistance to transient local thermal load, in current density and therefore in electrical losses with the same current flowing through the foil, and in rigidity.

In spite of the comparatively large thickness of the metal foils of the lamp according to the invention, they can be suitably embedded in glass of the lamp vessel. When during the manufacture of the lamp shown in FIG. 1 the metal foils 3 with the current conductors 10 and 11 have been slipped into a narrow tube of the lamp vessel 1, the glass surrounding the foils 3 can be moved towards these foils, for example by heating the tubes until they collapse around a respective foil. Alternatively, the glass may be pressed against the foils by means of pinch blocks, which approach above respectively below the plane of the drawing. The shape of the foils renders it possible for the glass to match the surface of the foils and to surround them between their ends 6, 7 in a vacuum-tight manner.

What is claimed is:

1. An electric lamp comprising:

a lamp vessel of glass having an $SiO_2$ content of at least 95% by weight, and having an electric element arranged therein;

inner current conductors which extend to the electric element;

outer current conductors; and a plurality of elongated metal foils each having a pair of major surface, each major surface extending in an elongated direction to a first and second end and being bounded by opposing side edges, each said side edge extending from the first and second ends, said pair of major surfaces meeting at each said side edge at an acute angle, each of said metal foils having a cross-section transverse to said side edges, each of said metal foils being connected at its respective first end to a respective inner current conductor, each of said metal foils also being connected at its respective second end to a respective outer current conductor, each of said metal foils being surrounding between its first and second ends in a vacuum-tight manner by glass of the lamp vessel, at least one said major surface comprising a pair of concave curvature portions each adjoining a respective side edge, and at least one convex curvature portion extending to at least one of said concave curvature portions.

2. An electric lamp as claimed in claim 1, wherein said at least one said major surface consists of a pair of concave curvature portions, and one convex curvature portion extending between said pair of concave curvature portions.

3. An electric lamp as claimed in claim 2, wherein the ratio of the width between said side edges and the largest thickness between said major surfaces is substantially less than 80 to 1.

4. An electric lamp as claimed in claim 1, wherein said at least one major surface consists of a pair of concave curvature portions, two convex curvature portions each extending to a respective concave curvature portion, and a flat portion extending between said convex curvature portions.

5. An electric lamp as claimed in claim 4, wherein said flat portion is disposed substantially halfway between said side edges.

6. An electric lamp as claimed in claim 5, wherein the ratio of the width between said side edges and the largest thickness between said major surfaces is substantially less than 80 to 1.

7. An electric lamp comprising:

a lamp vessel of glass having an $SiO_2$ content of at least 95% by weight, and having an electric element arranged therein;

inner current conductors which extend to the electric element;

outer current conductors; and a plurality of elongated metal foils each having a pair of major surfaces, each major surface extending in an elongated direction to a first and second end and being bounded by opposing side edges, each said side edge extending from the first and second ends said pair of major surfaces meeting at each said side edge at an acute angle, each of said metal foils having a cross-section transverse to said side edges, each of said metal foils being connected at its respective first end to a respective inner current conductor, each of said metal foils also being connected at its respective second end to a respective outer current conductor, each of said metal foils being surrounded between its first and second end in a vacuum-tight manner by glass of the lamp vessel, each of said major surfaces comprising a pair of concave curvature portions each adjoining a respective side edge, and at least one convex curvature portion extending to at least one of said concave curvature portions.

8. An electric lamp as claimed in claim 7, wherein said at least one convex curvature portion is a single portion extending between and connecting said pair of concave curvature portions.

9. An electric lamp as claimed in claim 8, wherein each of said major surfaces consists of a pair of concave curvature portions, two convex curvature portions each extending to a respective concave curvature portion, and a flat portion extending between said convex curvature portions.

10. An electric lamp as claimed in claim 9, wherein said flat portion is disposed substantially halfway between said side edges.

11. An electric lamp as claimed in claim 10, wherein said pair of major surfaces have symmetrically shaped portions.

12. An electric lamp as claimed in claim 11, wherein the ratio of the width between said side edges and the largest thickness between said major surfaces is substantially less than 80 to 1.

* * * * *